United States Patent [19]

Evans et al.

[11] Patent Number: 4,808,086

[45] **Date of Patent: * Feb. 28, 1989**

[54] ARTICLES AND METHODS FOR TREATING FABRICS

[75] Inventors: Mark D. Evans, Fairfield; Gregory B. Huntington, Cincinnati; Robert L. Stewart, Cincinnati; Peter H. Wolf, Cincinnati; Roger E. Zimmerer, Cincinnati, all of Ohio

[73] Assignee: The Procter & Gamble Company, Cincinnati, Ohio

[ * ] Notice: The portion of the term of this patent subsequent to Jun. 7, 2005 has been disclaimed.

[21] Appl. No.: 113,850

[22] Filed: Oct. 29, 1987

Related U.S. Application Data

[60] Division of Ser. No. 22,615, Mar. 3, 1987, Pat. No. 4,749,596, which is a continuation of Ser. No. 768,538, Aug. 22, 1985, abandoned, which is a continuation-in-part of Ser. No. 708,763, Mar. 6, 1985, abandoned.

[51] Int. Cl.[4] ..... B05D 3/12

[52] U.S. Cl. ..... 427/242; 34/9; 34/12; 252/8.6; 428/913; 428/224

[58] Field of Search ..... 427/242; 252/8.6; 428/913; 34/9, 12

[56] References Cited

U.S. PATENT DOCUMENTS

| | | | |
|---|---|---|---|
| 3,416,952 | 12/1968 | McIntyre et al. | 117/118 |
| 3,442,692 | 5/1969 | Gaiser | 117/120 |
| 3,632,396 | 1/1972 | Perez-Zamora | 117/76 P |
| 3,686,025 | 8/1972 | Morton | 117/140 R |
| 3,936,538 | 2/1976 | Marshall et al. | 427/242 |
| 3,959,230 | 5/1976 | Hay | 260/75 R |
| 3,962,152 | 6/1976 | Nicol et al. | 252/551 |
| 4,037,996 | 2/1978 | Bedenk et al. | 428/274 |
| 4,103,047 | 7/1978 | Zaki et al. | 427/242 |
| 4,237,155 | 12/1980 | Kardouche | 427/242 |
| 4,238,531 | 12/1980 | Rudy et al. | 427/242 |
| 4,526,694 | 7/1985 | Puchta et al. | 252/8.8 |

FOREIGN PATENT DOCUMENTS 1092435 11/1967 United Kingdom .

OTHER PUBLICATIONS

The Textile Manufacturer, 94, (1127), pp. 465–468 (1988).

*Primary Examiner*—James J. Bell

*Attorney, Agent, or Firm*—Leonard Williamson; Aylor Robert B.; Richard C. Witte

[57] ABSTRACT

Dryer-added fabric conditioning articles and methods utilizing a fabric softener agent and a polymeric soil release agent. More specifically, damp fabrics are commingled with softener active and polymeric soil release agent in an automatic soil release benefits concurrently with the drying operation. The softening and antistatic soil release agents herein are preferably employed in combination with a dispensing means adapted for use in an automatic dryer.

45 Claims, No Drawings

ARTICLES AND METHODS FOR TREATING FABRICS

CROSS-REFERENCE TO RELATED APPLICATION

This is a division of U.S. Ser. No. 022,615, U.S. Pat. No. 4,749,596, filed Mar. 3, 1987, which is a continuation of U.S. Ser. No. 768,538, filed Aug. 22, 1985, now abandoned, which is a continuation-in-part of U.S. Ser. No. 708,763, filed Mar. 6, 1985, also now abandoned.

TECHNICAL FIELD

The present invention encompasses articles and methods for providing soil release, softening, odor, and antistatic benefits to fabrics in an automatic laundry dryer.

BACKGROUND OF THE INVENTION

Treatment in an automatic clothes dryer has been shown to be an effective means for imparting desirable tactile properties to fabrics. For example, it is becoming common to soften fabrics in an automatic clothes dryer rather than during the rinse cycle of a laundering operation. (See U.S. Pat. No. 3,442,692, Gaiser, issued May 6, 1969).

Fabric "softness" is an expression well-defined in the art and is usually understood to be that quality of the treated fabric whereby its handle or texture is smooth, pliable and fluffy to the touch. Various chemical compounds have long been known to possess the ability to soften fabrics when applied to them during a laundering operation.

Fabric softness also connotes the absence of static "cling" in the fabrics, and the commonly used cationic fabric softeners provide both softening and antistatic benefits when applied to fabrics. Indeed, with fabrics such as nylon and polyester, the user is more able to perceive and appreciate an antistatic benefit than a true softening benefit.

On the other hand, soil release treatment of fabrics in an automatic clothes dryer is not as common as softening treatment.

U.S. Pat. No. 4,238,531, Rudy et al., issued Dec. 9, 1980, discloses in its Examples 8 and 9 a soil release agent adjuvant plus a "distributing aid," polyethylene glycol (PEG). The key combination of fabric softening plus soil release treatment in one automatic clothes dryer product is not disclosed in Rudy et al., or any other known prior art.

It is, therefore, an object of the present invention to provide fabric soil releasing plus softening articles for use in automatic dryers which are superior in soil release benefits and softening compared to the prior art.

This and other objects are obtained herein, as will be seen from the following disclosure.

SUMMARY OF THE INVENTION

The present invention encompasses an article of manufacture adapted for use to provide fabric soil release benefits and to soften fabrics in an automatic laundry dryer comprising:

(a) a fabric conditioning composition comprising a polymeric soil release agent and a solid fabric softening agent, and (b) a dispensing means which provides for release of an effective amount of said composition to fabrics in the dryer at automatic dryer operating temperatures, i.e., 35° C. to 115° C.

The invention also encompasses a method for imparting soil releasing benefits plus a softening and antistatic effect to fabrics in an automatic clothes dryer comprising tumbling said fabrics under heat in a clothes dryer with an effective, i.e., softening, amount of a composition comprising softening active(s) and a soil release agent. The soil release benefits for fabrics are provided for a wide range of soils including the oily types and, surprisingly, clay soils on polyester and polyester/cotton blend fabrics.

DESCRIPTION OF THE PREFERRED EMBODIMENT

The present invention encompasses an article of manufacture adapted for use to provide fabric soil release benefits and to soften fabrics in an automatic laundry dryer comprising:

(a) a fabric conditioning composition having a melting point above about 38° C. and being flowable at dryer operating temperatures, said composition comprising:
   i. 1% to 70% of a polymeric soil release agent;
   ii. 30% to 99% of a fabric softening agent;

(b) a dispensing means which provides for release of an effective amount of said composition to fabrics in the dryer at automatic dryer operating temperatures, i.e., 35° C. to 115° C.

When the dispensing means is a flexible substrate in sheet configuration the fabric conditioning composition is releasably affixed on the substrate to provide a weight ratio of conditioning composition to dry substrate ranging from about 10:1 to about 0.5:1.

The invention also encompasses a method for imparting soil releasing benefits plus a softening and antistatic effect to fabrics in an automatic clothes dryer comprising tumbling said fabrics under heat in a clothes dryer with an effective, i.e., softening, amount of a composition comprising softening active(s) and a soil release agent.

The term "fabric conditioning composition" as used herein is defined as a mixture of a polymeric soil release agent and a fabric softening agent as defined herein.

POLYMERIC SOIL RELEASE AGENT

The polymeric soil release agents useful in the present invention include hydroxyether cellulosic polymers, block copolymers of polyethylene terephthalate and polyoxyethylene terephthalate, block copolymers of polyethylene phthalate and polyethylene glycol, and cationic guar gums, and the like. The soil release agent is present at a level of from about 1% to about 70%, more preferably from about 10% to about 70%, and most preferably from about 25% to about 50%, by weight of the fabric conditioning composition.

The cellulosic derivatives that are functional as soil release agents may be characterized as certain hydroxyethers of cellulose such as Methocel HB-15000 (Dow), Methyl Cellulose DM-140 (Buckeye), and Klucel (Hercules); also, certain cationic cellulose ether derivatives such as Polymer JR-125, JR-400, and JR-30 M (Union Carbide).

Other effective soil release agents are cationic guar gums such as Jaguar Plus (Stein Hall) and Gendrive 458 (General Mills).

A preferred fabric conditioning composition has a polymeric soil release agent selected from the group consisting of methyl cellulose, hydroxypropyl methylcellulose, or hydroxybutyl methylcellulose, said cellulosic polymer having a viscosity in 2% aqueous solution at 20° C. of 15 to 75,000 centipoise.

A more preferred soil release agent is a copolymer having blocks of polyethylene terephthalate and polyoxyethylene terephthalate. More specifically, these polymers are comprised of repeating units of ethylene terephthalate and polyoxyethylene terephthalate at a molar ratio of ethylene terephthalate units to polyoxyethylene terephthalate units of from about 25:75 to about 35:65, said polyoxyethylene terephthalate containing polyoxyethylene blocks having molecular weights of from about 300 to about 700. The molecular weight of this polymeric solid release agent is in the range of from about 25,000 to about 55,000. These preferred polymers are disclosed in U.S. Pat. No. 3,959,230, Hays, issued May 25, 1976, incorporated herein by reference. The melting point of the polymer is preferably below 100° C.

Another preferred polymeric solid release agent is a crystallizable polyester copolymer with repeat units of ethylene terephthalate units containing 10–50% by weight of ethylene terephthalate units together with 90–50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. A more preferred polymer is that wherein the polyoxyethylene terephthalate units are derived from a polyoxyethylene glycol with an average molecular weight of from about 1,000 to about 4,000. These polymers are disclosed in U.S. Pat. No. 3,416,952, McIntyre and Robertson, issued Dec. 17, 1968, incorporated herein by reference. Examples of these copolymers include the commercially available material Zelcon® 4780 (from DuPont) and Milease® T (from ICI), both have the Chemical Abstracts Service Registry No. 9016-88-0. Both Zelcon 4780 and Milease T are sold in the aqueous dispersion form containing up to 85% water. It is preferable to use the dehydrated polymer to prepare the fabric conditioning composition in order to avoid the incorporation of excess moisture which is believed to make the resulting fabric conditioning articles wet and sticky. The dehydrated polymer is obtained by drying the above-mentioned commercial dispersions, or can be obtained directly in the concentrated form from the manufacturers. An example of the latter is Zelcon PG, the concentrated form of Zelcon 4780, and is obtained from DuPont Co.

The most preferred polymer is a solid at room temperature, has a softening phase transition temperature at or above 30° C. and becomes a flowable liquid below 100° C., preferably below 90° C. The softening phase transition temperature can be determined by the differential scanning calorimetry method. A polymer that is a hard solid at room temperature is desirable in order to keep the fabric conditioning sheets from having a tacky feel, while its softening and fluidity at higher temperatures facilitate the substrate coating process and the subsequent fabric conditioning active transfer from the fabric conditioning sheet to the fabrics in the clothes dryer.

A particularly preferred polymeric soil release agent is disclosed in U.S. patent application Ser. No. 684,511, of Eugene P. Gosselink, filed Dec. 21, 1984, incorporated herein by reference, has the formula:

$$X\text{-}[(OCH_2CH_2)_n(OR^5)_m]\text{-}[(A\text{—}R^1\text{—}A\text{—}R^2)_u(A\text{—}R^3\text{—}A\text{—}R^2)_v]\text{-}$$

$$\text{—}A\text{—}R^4\text{—}A\text{-}[(R^5O)_m(CH_2CH_2O)_n]\text{-}X$$

wherein the A moieties are essentially $$\text{—}\overset{O}{\overset{\|}{C}}\text{—} \quad \text{or} \quad \text{—}\overset{O}{\overset{\|}{C}}\text{O—}$$

moieties; the $R^1$ moieties are essentially 1,4-phenylene moieties; and $R^2$ moieties are essentially ethylene moieties, or substituted ethylene moieties having $C_1$–$C_4$ alkyl or alkoxy substituents; the $R^3$ moieties are substituted $C_2$–$C_{18}$ hydrocarbylene moieties having at least one $\text{—}SO_3M$, —COOM, $\text{—O-}[(R^5O)_m(CH_2CH_2O)_n]\text{-}X$ or $\text{—A-}[(R^2\text{—A—}R^4\text{—A})]_w[(R^5O)_m(CH_2CH_2O)_n]\text{-}X$ substituent or at least one moiety $\text{—A-}[(R^2\text{—A—}R^4\text{—A})]_wR^2\text{—A—}$ crosslinked to another $R^3$ moiety; the $R^4$ moieties are $R^1$ or $R^3$ moieties, or a mixture thereof; each $R^5$ is $C_3$–$C_4$ alkylene, or the moiety $\text{—}R^2\text{—A—}R^6\text{—}$, wherein $R^6$ is a $C_1$–$C_{12}$ alkylene, alkenylene, arylene or alkarylene moiety; each M is H or a water-soluble cation; each X is H, $C_1$–$C_4$ alkyl or $$\text{—}\overset{O}{\overset{\|}{C}}R^7,$$

wherein $R^7$ is $C_1$–$C_4$ alkyl; m and n are numbers such that the moiety —$(CH_2CH_2O)$-comprises at least about 50% by weight of the moiety $[(R^5O)_m(CH_2CH_2O)_n]$, provided that when $R^5$ is the moiety $\text{—}R^2\text{—A—}R^6\text{—}$, m is 1; each n is at least about 10; u and v are numbers such that the sum of u+v is from about 3 to about 25; w is 0 or at least 1; and when w is at least 1, u, v and w are numbers such that the sum of u+v+w is from about 3 to about 25.

This latter polymer is particularly preferred when the formula is:

$$X\text{—}(OCH_2CH_2)_n\text{-}[(\text{—}\overset{O}{\overset{\|}{C}}\text{—}R^1\text{—}\overset{O}{\overset{\|}{C}}\text{O—}R^2)]_u\text{O}\overset{O}{\overset{\|}{C}}\text{—}R^1\text{—}\overset{O}{\overset{\|}{C}}\text{O—}(CH_2CH_2O)_n\text{—}X$$

wherein each $R^1$ is a 1,4-phenylene moiety; the $R^2$ consist essentially of ethylene moieties, 1,2-propylene moieties or a mixture thereof; each X is ethyl or preferably methyl; each n is from about 12 to about 43; u is from about 3 to about 10.

A preferred polymeric soil release agent is POET (polyoxyethylene terephthalate), a compound with the general formula described hereinabove. It is synthesized from the following reactants:

1. Poly(ethylene glycol)methyl ester, M.W. 750, Aldrich Chemical Co., 1000 g (1.33 moles)
2. Dimethyl terephthalate, M.W. 185, Aldrich Chemical Co., 359.9 g (1.85 moles)
3. Ethylene glycol, M.W. 62, Aldrich Chemical Co., 146.4 g (2.36 moles)
4. Calcium acetate, MCB, 7.9 g (catalyst)
5. Antimony trioxide, Fisher Scientific, 7.9 g (catalyst)

6. Butylated hydroxytoluene, Aldrich Chemical Co., 3.6 g (antioxidant).

The reaction was carried out by adding all of the above to a 2 liter round bottom flask equipped with mechanical agitation. A 14 inch unpacked column was also fitted to the flask for methanol distillation. The system was placed under a nitrogen atmosphere and the temperature was gradually raised to 200° C. once the reaction mixture melted. Reaction conditions of 200° C., atmospheric pressure, and constant mechanical agitation were maintained for 20 hours. To further drive the ester interchange reaction to completion, the reaction mixture was cooled to 130° C., the methanol receiving flask was emptied, and vacuum was applied while concurrently introducing nitrogen sparge below the level of the liquid reaction mixture. An absolute pressure of 25 mm Hg was obtained. Over a period of 2 hours the temperature was gradually raised to 190° C., distilling more methanol and ethylene glycol. To complete the reaction, the temperature was raised to 200° C. and the pressure was reduced to 20 mm Hg. The nitrogen flow into the reaction mixture was discontinued. After 3.5 hours, the reaction was essentially complete as indicated by reverse phase HPLC analysis. (Using a column packed with hexyl capped silica particles and an acetonitrile/water gradient elution). This analysis showed that a sizable part of the polymer contained 4 or more terephthalate units per molecule. The general formula for the resulting compound is:

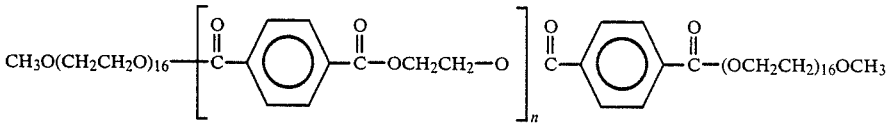

wherein n=1.75 on average.

The resulting polymer was submitted to a three-solvent (short chain alcohols) extraction (IPA, EtOH, MeOH) and the EtOH, MeOH soluble fractions are combined in the ratio of 67:33.

This extraction procedure results in a polymer sample containing predominantly 3 to 5 terephthalate units per molecule as shown by HPLC analysis.

In general, the soil release polymer is preferably a solid at room temperature, has a softening phase transition temperature at or above 30° C. and becomes a flowable liquid below 100° C., more preferably below 90° C.

FABRIC SOFTENING AGENT

The term "fabric softening agent" as used herein includes cationic and nonionic fabric softeners used alone and also in combination with each other. The preferred fabric softening agent of the present invention is a mixture of cationic and nonionic fabric softeners.

Examples of fabric softening agents are the compositions described in U.S. Pat. Nos. 4,103,047, Zaki et al., issued July 25, 1978; 4,237,155, Kardouche, issued Dec. 2, 1980; 3,686,025, Morton, issued Aug. 22, 1972; 3,849,435, Diery et al., issued Nov. 19, 1974; and U.S. Pat. No. 4,037,996, Bedenk, issued Feb. 14, 1978; said patents are hereby incorporated herein by reference. Particularly preferred cationic fabric softeners of this type include quaternary ammonium salts such as dialkyl dimethylammonium chlorides, methylsulfates and ethylsulfates wherein the alkyl groups can be the same or different and contain from about 14 to about 22 carbon atoms. Examples of such preferred materials include ditallowalkyldimethylammonium methylsulfate, distearyldimethylammonium methylsulfate, dipalmityldimethylammonium methylsulfate and dibehenyldimethylammonium methylsulfate. Also particularly preferred is the carboxylic acid salt of a tertiary alkylamine disclosed in said Kardouche patent. Examples include stearyldimethylammonium stearate, distearylmethylammonium myristate, stearyldimethylammonium palmitate, distearylmethylammonium palmitate, and distearylmethylammonium laurate. These carboxylic salts can be made in situ by mixing the corresponding amine and carboxylic acid in the molten fabric conditioning composition.

Examples of nonionic fabric softeners are the sorbitan esters, described herein and $C_{12}$–$C_{26}$ fatty alcohols and fatty amines as described herein.

A preferred article of the present invention includes a fabric conditioning composition which comprises 10% to 70% of polymeric soil release agent, and 30% to 90% of a fabric softening agent, said fabric softening agent is selected from cationic and nonionic fabric softeners, and mixtures thereof. Preferably, said fabric softening agent comprises a mixture of about 5% to about 80% of a cationic fabric softener and about 10% to about 85% of a nonionic fabric softener by weight of said fabric conditioning composition. The selection of the components is such that the resulting fabric conditioning composition has a melting point above about 38° C. and being flowable at dryer operating temperatures.

A preferred fabric softening agent comprises a mixture of $C_{10}$–$C_{26}$ alkyl sorbitan esters and mixtures thereof, a quaternary ammonium salt and an tertiary alkylamine. The quaternary ammonium salt is preferably present at a level of from about 5% to about 25%, more preferably from about 7% to about 20% of the fabric conditioning composition. The sorbitan ester is preferably present at a level of from about 10% to about 50%, more preferably from about 20% to about 40%, by weight of the total fabric conditioning composition. The tertiary alkylamine is present at a level of from about 5% to about 25%, more preferably from 7% to about 20% by weight of the fabric conditioning composition. The preferred sorbitan ester comprises a member selected from the group consisting of $C_{10}$–$C_{26}$ alkyl sorbitan monoesters and $C_{10}$–$C_{26}$ alkyl sorbitan diesters, and ethoxylates of said esters wherein one or more of the unesterified hydroxyl groups in said esters contain from 1 to about 6 oxyethylene units, and mixtures thereof. The quaternary ammonium salt is preferably in the methylsulfate form. The preferred tertiary alkylamine is selected from the group consisting of alkyldimethylamine and dialkylmethylamine and mixtures thereof, wherein the alkyl groups can be the same or different and contain from about 14 to about 22 carbon atoms.

Another preferred fabric softening agent comprises a carboxylic acid salt of a tertiary alkylamine, in combination with a fatty alcohol and a quaternary ammonium salt. The carboxylic acid salt of a tertiary amine is used in the fabric conditioning composition preferably at a level of from about 5% to about 50%, and more preferably, from about 15% to about 35%, by weight of the fabric conditioning composition. The quaternary ammonium salt is used preferably at a level of from about 5% to about 25%, and more preferably, from about 7% to about 20%, by weight of the total fabric conditioning composition. The fatty alcohol can be used preferably at a level of from about 10% to about 25%, and more preferably from about 10% to about 20%, by weight of the fabric conditioning composition. The preferred quaternary ammonium salt is selected from the group consisting of dialkyl dimethylammonium salt wherein the alkyl groups can be the same or different and contain from about 14 to about 22 carbon atoms and wherein the counteranion is selected from the group consisting of chloride, methylsulfate and etylsulfate, preferably methylsulfate. The preferred carboxylic acid salt of a tertiary alkylamine is selected from the group consisting of fatty acid salts of alkyldimethylamines wherein the alkyl group contains from about 14 to about 22 carbon atoms. The preferred fatty alcohol contains from about 14 to about 22 carbon atoms.

OPTIONAL INGREDIENTS

Well known optional components included in the fabric conditioning composition which are useful in the present invention are narrated in U.S. Pat. No. 4,103,047, Zaki et al., issued July 25, 1978, for "Fabric Treatment Compositions," incorporated herein by reference.

DISPENSING MEANS

The fabric conditioning compositions can be employed by simply adding a measured amount into the dryer, e.g., as liquid dispersion. However, in a preferred embodiment, the fabric conditioners are provided as an article of manufacture in combination with a dispensing means such as a flexible substrate which effectively releases the composition in an automatic clothes dryer. Such dispensing means can be designed for single usage or for multiple uses.

One such article comprises a sponge material releasably enclosing enough fabric conditioning composition to effectively impart fabric soil release and softness benefits during several cycles of clothes. This multi-use article can be made by filling a hollow sponge with about 20 grams of the fabric conditioning composition.

Other devices and articles suitable for dispensing the fabric conditioning composition into automatic dryers include those described in U.S. Pat. Nos. 4,103,047, Zaki et al., issued July 25, 1978; 3,736,668, Dillarstone, issued June 5, 1973; 3,701,202, Compa et al., issued Oct. 31, 1972; 3,634,947, Furgal, issued Jan. 18, 1972; 3,633,538, Hoeflin, issued Jan. 11, 1972; and 3,435,537, Rumsey, issued Apr. 1, 1969. All of these patents are incorporated herein by reference.

A highly preferred article herein comprises the fabric conditioning composition releasably affixed to a flexible substrate in a sheet configuration. Highly preferred paper, woven or nonwoven "absorbent" substrates useful herein are fully disclosed in Morton, U.S. Pat. No. 3,686,025, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Determination of absorbent capacity values is made by using the capacity testing procedures described in U.S. Federal Specifications UU-T-595b, modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., kraft or bond having a basis weight of about 32 pounds per 3,000 square feet) has an absorbent capacity of 3.5 to 4, commercially available household one-ply toweling paper has a value of 5 to 6; and commercially available two-ply household toweling paper has a value of 7 to about 9.5.

Using a substrate with an absorbent capacity of less than 4 tends to cause too rapid release of the fabric conditioning composition from the substrate resulting in several disadvantages, one of which is uneven conditioning of the fabrics. Using a substrate with an absorbent capacity over 12 is undesirable, inasmuch as too little of the fabric conditioning composition is released to condition the fabrics in optimal fashion during a normal drying cycle.

Such a substrate comprises a nonwoven cloth having a absorbent capacity of preferably from about 5 to 7 and wherein the weight ratio of fabric conditioning composition to substrate on a dry weight basis ranges from about 5:1 to 1:1.

Nonwoven cloth substrate preferably comprises cellulosic fibers having a length of from 3/16 inch to 2 inches and a denier of from 1.5 to 5 and the substrate is adhesively bonded together with a binder resin.

The flexible substrate preferably has openings sufficient in size and number to reduce restriction by said article of the flow of air through an automatic laundry dryer. The better openings comprise a plurality of rectilinear slits extended along one dimension of the substrate.

USAGE

The method aspect of this invention for imparting the abovedescribed fabric conditioning composition to provide soil release, softening and antistatic effects to fabrics in an automatic laundry dryer comprises: commingling pieces of damp fabrics by tumbling said fabrics under heat in an automatic clothers dryer with an effective amount of the fabric conditioning composition, said composition having a melting point greater than about 38° C. and being flowable at dryer operating temperature, said composition comprising from about 1% to 70% of a polymeric soil release agent, and 30% to 99% of a fabric softening agent selected from the above-defined cationic and nonionic fabric softeners and mixtures thereof.

The method herein is carried out in the following manner. Damp fabrics, usually containing from about 1 to about 1.5 times their weight of water, are placed in the drum of an automatic clothes dryer. In practice, such damp fabrics are commonly obtained by laundering, rinsing and spin-drying the fabrics in a standard washing machine. The fabric conditioning composition can simply be spread uniformly over all fabric surfaces, for example, by sprinkling the composition onto the fabrics from a shaker device. Alternatively, the composition can be sprayed or otherwise coated on the dryer drum, itself. The dryer is then operated in standard fashion to dry the fabrics, usually at a temperature from about 50° C. to about 80° C. for a period from about 10 minutes to about 60 minutes, depending on the fabric load and type. On removal from the dryer, the dried fabrics have been treated for soil release benefits and are softened. Moreover, the fabrics instantaneously sorb a minute quantity of water which increases the electrical conductivity of the fabric surfaces, thereby quickly and effectively dissipating static charge.

In a preferred mode, the present process is carried out by fashioning an article comprising the substrate-like dispensing means of the type hereinabove described in releasable combination with a fabric conditioning composition. This article is simply added to a clothes dryer together with the damp fabrics to be treated. The heat and tumbling action of the revolving dryer drum evenly distributes the composition over all fabric surfaces, and dries the fabrics.

The following are nonlimiting examples of the instant articles and methods.

TABLE I

| Fabric Conditioning Composition Components | Examples: 1 Wt. % | 2 Wt. % | 3 Wt. % | 4 Wt. % | 5 Wt. % | 6 Wt. % | 7 Wt. % | 8 Wt. % | 9 Wt. % | 10 Wt. % |
|---|---|---|---|---|---|---|---|---|---|---|
| Soil Release Agents: | | | | | | | | | | |
| Dried Zelcon 4780[a] | 37.2 | 43.5 | — | 44.1 | — | — | 45.4 | — | — | 75 |
| Dred Milease T[b] | — | — | 43.5 | — | — | — | — | — | — | — |
| POET[c] | — | — | — | — | 37.5 | — | — | 67.0 | — | — |
| Methocel A15LV[d] | — | — | — | — | — | 23.6 | — | — | — | — |
| Fabric Softening Agents: | | | | | | | | | | |
| DTDMAMS[e] | 14.1 | 12.7 | 12.7 | 12.25 | 11.25 | 15 | 11.1 | — | 21.9 | — |
| DTMA[f] | 14.1 | 12.7 | 12.7 | 12.25 | 11.25 | 15 | — | — | 21.9 | — |
| SMS[g] | 28.2 | 25.4 | 25.4 | 24.5 | 22.5 | 30 | — | 33.0 | 43.8 | — |
| SDMA[h] | — | — | — | — | — | — | 13.9 | — | — | — |
| $C_{16}$-$C_{18}$ Fatty Acid | — | — | — | — | — | — | 12.8 | — | — | — |
| $C_{16}$-$C_{18}$ Fatty Alcohol | — | — | — | — | — | — | 11.1 | — | — | — |
| PEG 8000 | — | — | — | — | 12.5 | — | — | — | — | 25 |
| Parvan 5250[i] | — | — | — | — | — | 7.9 | — | — | — | — |
| Clay[j] | 6.4 | 5.7 | 5.7 | 5.6 | 5.0 | 6.8 | 4.4 | — | 10.0 | — |
| Perfume | — | — | — | 1.3 | — | 1.7 | 1.3 | — | 2.4 | — |
| | 100.0% | 100.0% | 100.0% | 100.0% | 100.0% | 100.0% | 100.0% | 100.0% | 100.0% | 100.0% |
| Article Composition: | | | | | | | | | | |
| Substrate weight, grams/sq.yd. | 16 | 18 | 18 | 18 | 16 | 16 | 16 | 16 | 16 | 16 |
| Coating weight, grams/9" × 11" sheet | 4.1 | 4.6 | 4.6 | 4.6 | 2.6 | 3.5 | 3.3 | 3.1 | 2.6 | 2.6 |

[a]Zelcon 4780 is an ethylene terephthalate-polyoxyethylene glycol copolymer (CAS registry No. 9016-88-0) sold by E. I. DuPont as a 15% dispersion in water. Dried Zelcon 4780 is the dehydrated dispersion dried in a thin film at approximately 100° C. Zelcon 4780 is also described herein in the section entitled "Polymeric Soil Release Agent."

[b]Milease T is also an ethylene terephthalate-polyoxyethylene glycol copolymer (CAS registry No. 9016-88-0) sold by ICI as a 15% dispersion in water. Dried Milease T is the dehydrated dispersion dried in a thin film at approximately 100° C. This polymer is further described in the section herein entitled "Polymeric Soil Release Agent."

[c]POET (polyoxyethylene terephthalate) is a compound with the general formula described hereinabove. It is synthesized from the following reactants:

1. Poly(ethylene glycol)methyl ester, M.W. 750, Aldrich Chemical Co., 1000 g (1.33 moles)
2. Dimethyl terephthalate, M.W. 195, Aldrich Chemical Co., 359.9 g (1.85 moles)
3. Ethylene glycol, M.W. 62, Aldrich Chemical Co., 146.4 g (2.36 moles)
4. Calcium acetate, MCB, 7.9 g (catalyst)
5. Antimony trioxide, Fisher Scientific, 7.9 g (catalyst)
6. Butylated hydroxytoluene, Aldrich Chemical Co., 3.6 g (antoxidant).

The resulting polymer is submitted to a three-solvent (short chain alcohols) extracton (IPA, EtOH, MeOH) and the EtOH, MeOH soluble fractions are combined in the ratio of 67:33.

[d]Methocel A15LV is a methyl cellulose sold by Dow Chemical Co.

[e]DTDMAMS is ditallowdimethylammonium methylsulfate.

[f]DTMA is ditallowmethylamine.

[g]SMS is sorbitanmonostearate.

[h]SDMA is stearyldimethylamine.

[i]Parvan 5250 is a refined petroleum wax sold by Exxon Co.

[j]Bentolite L sold by Southern Clay Products.

EXAMPLES 1-3, 5-10

The components in Examples 1-3, and 5-10 were admixed and liquified at 70° C. Each nonwoven substrate, comprised of 70% 3-denier, 1-9/16" long rayon fibers with 30% polyvinyl acetate binder, is cut into a 9"×11" sheet. Slightly more than target coating weight is distributed on a heating plate and the nonwoven cloth is placed over it. A small paint roller is used to impregnate the mixture into the interstices of the substrate. The article is removed from the hot plate and allowed to cool to room temperature whereby the mixture solidifies. Following solidification of the fabric conditioning composition, the cloth is slit with a knife. (Conveniently, the cloth is provided with 3 to 9 rectilinear slits extending along one dimension of the substrate, said slits being in substantially parallel relationship and extending to within about 1" from at least one edge of said dimension of the substrate). The width of an individual slit is about 0.2".

EXAMPLE 4

A dryer-added fabric conditioning article comprising a rayon nonwoven fabric substrate (having a weight of 1.4 gm per 99 sq.in.) and a fabric conditioning composition is prepared in the following manner.

The fabric conditioning composition comprising 44.1% dried Zelcon 4780, 12.2% ditallowdimethylammonium methylsulfate, 12.2% ditallowmethylamine, 24.5% sorbitan monostearate, 5.6% clay, and 1.3% perfume is liquified by admixing the individual components at 70° C. Thus the fabric conditioning composition contains 44.1% polymeric soil release agent and 55.9% fabric softening agent. The flexible substrate, comprised of 70% 3-denier, 1-9/16" long rayon fibers and 30% polyvinyl acetate binder, is impregnated by coating one side of a continuous length of the substrate and contacting it with a rotating cylindrical member which serves to press the liquified mixture into the interstices of the substrate. The substrate is passed over several chilled tensioning rolls which help solidify the conditioning mixture. The substrate sheet is 9" wide and is perforated in lines at 11" intervals to provide detachable sheets. Each sheet is cut with a set of knives to provide three evenly spaced parallel slits averaging about 4" in length.

FABRIC SOFTENING AND SOIL RELEASE EVALUATIONS

The fabric softening and soil release performance of the articles is determined by means of a fabric softening evaluation and a soil release evaluation. In such evaluations, 5¼ lb. loads of fabric representing a range of fabric types (cotton, polyester/cotton, polyester, acrylics, and nylon) are washed using a leading detergent, a 14 minute wash cycle with warm (100° F.) medium hardness (8–10 grains/gallon) water, a 2 minute rinse in cold (60° F.) water, and are dried for 45 minutes in standard household clothes dryer with the appropriate test treatment (product). Included in each 5¼ lb. fabric load are four 100% cotton terry cloths to be used for softness grading and four each, selected 12"×12" swatches of 100% polyester, or 65%/35% polyester/cotton to be used for soil release evaluation. [All terries and soil release swatches are prewashed in the following manner to remove any "factory finishes": terries and swatches are laundered using IVORY SNOW® detergent, a 14 minute wash cycle with hot (150° F.) medium hardness (8–10 grains/gallon) water, and a 2 minute rinse in hot (150° F.) water. The entire wash and rinse cycles are then repeated in ERA® detergent. This is followed by two 6 minute wash and 2 minute rinse cycles in hot (150° F.) water. The prewashed terries and swatches are then dried and added to the test wash load.] Following washing and drying, the cotton terry cloths are removed from each fabric load for subsequent softening evaluation. The 5¼ lb. bundles containing the swatches for soil release evaluation are then rewashed and dried using the same procedures cited above for a total of 3 washes and 3 dries.

SOFTNESS EVALUATION

For fabric softening evaluation, the cotton terry cloths are graded "blind" by three qualified judges to determine softness performance of the different treatments (products). The comparison between treatments is expressed in terms of grading scale units (GSU) where:

0 GSU=no difference
1 GSU=a slight difference
2 GSU=a moderate difference
3 GSU=a large difference
4 GSU=a very large difference.

All treatment comparisons (judges grades) are summarized and subjected to a statistical one way analysis of variance. The treatment relationships are reported in terms of grading scale units (GSU) along with a statistical estimate of test precision. (Least significant difference, i.e., LSD).

For softness evaluation, the example articles of the present invention (Examples 2 and 5) and the other article (Example 9) are evaluated in separate tests, but both types of articles are compared to a "no softener" control.

Results of the softness grading are summarized in Table II.

TABLE II

| Softness Data (Grading Scale Units) | |
|---|---|
| No Softner Control | 0 |
| Example 2 | 1.21s |
| Example 5 | 1.79s |
| Example 9 | 1.60s |
| Average LSD = 0.31 | |

The Table II data demonstrate that the articles of the instant invention (Examples 2 and 5) provide fabric softening performance comparable to that of similar prior art fabric softening articles (Example 9).

SOIL RELEASE EVALUATION

For soil release evaluation, the polyester and polyester/cotton swatches are removed from the fabric loads after the third wash and dry cycle. Stains such as dirty motor oil, spaghetti, grass, and clay are applied to each swatch in a 2" circle using a standard paint brush. Swatches are stored overnight (about 12–16 hours) at 40° F. to set the stains. The next day swatches are allowed to equilibrate to room temperature and are then washed in identical 5¼ lb. fabric loads and under the same conditions as described above. They are dried for 45 minutes in standard household clothes dryers using no fabric conditioning material.

The swatches are graded "blind" by three qualified judges to determine soil release performance of the different treatments (products). The comparison between treatments is expressed in terms of grading scale units (GSU) where:

0 GSU=no difference
1 GSU=a slight difference
2 GSU=a moderate difference
3 GSU=a large difference
4 GSU=a very large difference.

All treatment comparisons (judges grades) are summarized and subjected to typical one way analysis of variance. The treatment relationships are reported in terms of grading scale units (GSU) along with a statistical estimate of test precision. (Least significant difference, i.e., LSD).

For soil release evaluation, the articles of the present invention which include polymeric soil release agents and fabric softening agents are the articles described in Examples 1 through 8. Also tested for comparison are various other articles for stain protection through the dryer (Examples 9 and 10). In addition, data from direct application of a soil release polymer are included.

In Example 11, Zelcon 4780 (dispersion) is applied directly (by pipette) to swatches in the amount of approximately 1.0 g of Zelcon polymer/lb. swatch. These swatches are air dried, then stained, stored, and washed as described above. The results of the soil release gradings are summarized in Tables III A–C.

The above-described fabric treatment and soil release evaluation procedures are illustrative of the invention herein and are not to be construed as limiting thereof.

TABLE III

| | Control Detergent Alone | Softener[k] Alone | Soil Release Agent[l] Alone | Soil Release Agent[m] Direct Application* | EX. 1 | EX. 2 | EX. 3 | EX. 4 | EX. 5 | EX. 6 | EX. 7 | EX. 8* |
|---|---|---|---|---|---|---|---|---|---|---|---|---|
| | Soil Release Data | | | | | | | | | | | |
| Detergent: | TIDE or ERA | TIDE | TIDE | TIDE | TIDE | ERA | TIDE | TIDE | TIDE | TIDE | TIDE | TIDE |
| Sheets per Cycle: | 0 | 1 | 1 | 0 | 1 | 1 | 1 | 1 | 2 | 1 | 1 | 2 |
| Dirty Motor Oil | | | | | | | | | | | | |
| 100% Polyester | 0 | −0.83 | 2.67s | −0.5 | 0.4 | 4.3s | −0.2 | 0.5 | 1.67s | −0.5 | — | 1.5 |
| 65/35 Poly/Cotton | 0 | −0.08 | 1.75s | 0.7 | 0.5 | — | — | 1.1s | 1.58s | −0.2 | 0.4 | 2.1 |
| Spaghetti | | | | | | | | | | | | |
| 100% Polyester | 0 | −0.83 | 2.17 | — | −1.1 | 3.1s | 3.0s | 2.7s | 1.33s | 0.1 | 4.7s | 2.6 |
| 65/35 Poly/Cotton | 0 | −1.58s | 1.25 | 1.5 | 2.6s | — | — | −0.2 | −0.25 | −0.3 | — | −0.6 |
| Grass | | | | | | | | | | | | |
| 100% Polyester | 0 | 0.50s | 0.58s | 1.2 | — | — | — | 2.2s | 2.25s | 1.3s | 3.9s | 3.6 |
| 65/35 Poly/Cotton | 0 | 0.58 | −0.25 | 1.8 | — | — | — | 1.7s | 2.17s | 1.8 | 2.6s | 3.5 |
| Clay | | | | | | | | | | | | |
| 100% Polyester | 0 | 1.00 | −0.25 | −1.4 | 1.9s | 2.9s | 2.0s | 1.4s | 1.08 | 2.1s | 2.1s | 1.4 |
| 65/35 Poly/Cotton | 0 | 2.50s | 0.50 | −0.3 | 2.4s | — | — | 1.9s | 2.08s | 2.3s | 3.2s | 2.5 |

s = Significantly different than detergent alone at 95% confidence level.
*Significance calculation not available. Data tabulated by hand.
[k]This is Example 9, a softener without soil release agent (SRA), i.e., 21.9% ditallowdimethylammonium methylsulfate, 21.9% ditallowmethylamine, 43.8% sorbitan monostearate, 10% clay, 2.4% perfume on a nonwoven rayon substrate weighing 16 g/sq.yd.
[l]This is Example 10, an SRA without fabric softener with 75% dried Zelcon 4780, 25% PEG 8000 on a nonwoven rayon substrate weighing 16 g/sq.yd..
[m]This is Example 11, an SRA directly applied to a fabric swatch with Zelcon 4780 applied by pipette directly to the stain swatches.

It should be noted that where 2 sheets of the article per cycle are used the benefits are thereby increased. These data are relative to the detergent only control. These data demonstrate that the articles of the present invention, Examples 1–8, provide soil release performance on both greasy/oily and clay stains, whereas Examples 9, 10 and 11 provided soil release performance on only greasy/oil stains or clay stains. In fact, Examples 11, showing soil release performance of the soil release action directly applied, exhibited poorer clay removal than detergent alone.

EXAMPLE 12

A dryer-added fabric conditioning article comprising a rayon nonwoven fabric substrate (having a weight of 1.4 gm per 99 sq. in.) and a fabric conditioning composition is prepared in the following manner.

A fabric softening agent premixture is initially prepared by admixing 140 parts of stearlydimethylamine with 128 parts of $C_{16}$–$C_{18}$ fatty acid at 70° C. The softening agent mixture is completed by then adding and mixing in 112 parts of $C_{16}$–$C_{18}$ fatty alcohol and 112 parts of ditallowdimethylammonium methylsulfate at 70° C. To the softening agent mixture 420 parts of premelted polyethylene terephthalate-polyoxyethylene terephthalate copolymeric soil release agent (which is solid at room temperature and is a flowable liquid at 85° C.) is added slowly and with highshear mixing to finely disperse the polymer. After the addition is completed and a sufficient period of mixing time has elapsed, 61 parts of Bentolite L particulate clay is added slowly while maintaining the high-shear mixing action. An amount of 27 parts of perfume is added to complete the preparation of the fabric conditioning composition. Impregnation of the flexible substrate with the fabric conditioning composition is carried out in the same manner as depicted in Example 4. The resulting fabric conditioning sheets have a dry, nonsticky tactile feel, and deliver good soil release and softening performance.

What is claimed is:

1. An article of manufacture adapted for providing fabric soil release and softening benefits within an automatic clothes dryer, said article comprising:

(a) a fabric conditioning composition being solid at room temperature and flowable at dryer operating temperatures, said fabric conditioning composition comprising:

i. 1% to 70% of a polymeric soil release agent; and ii. 30% to 99% of a fabric softening agent selected from cationic and nonionic fabric softeners and mixtures thereof;

(b) dispensing means which provides for release of said conditioning composition within an automatic laundry dryer at dryer operating temperatures.

2. An article according to claim 1 wherein said dispensing means comprises a flexible substrate in sheet configuration having the fabric conditioning composition releasably affixed thereto to provide a weight ratio of fabric conditioning composition to dry substrate ranging from about 10:1 to about 0.5:1.

3. An article according to claim 2 wherein said polymeric soil release agent is present at a level of from about 10% to about 70% by weight of the fabric conditioning composition.

4. An article according to claim 2 wherein said fabric softening agent comprises a mixture of from about 5% to about 80% of a cationic fabric softener and from about 10% to about 85% of a nonionic fabric softener by weight of said fabric conditioning composition.

5. An article according to claim 4 wherein said cationic fabric softener is selected from the group consisting of:

(a) a quaternary ammonium salt; and (b) a carboxylic acid salt of a tertiary alkylamine; and mixtures of (a) and (b); and wherein said nonionic fabric softener is selected from the group consisting of:

(c) a fatty alkyl sorbitan ester;

(d) a fatty alcohol; and (e) a fatty amine;

and binary and ternary mixtures of (c), (d) and (e).

6. An article according to claim 3 wherein the soil release agent is a polymer comprising repeating units of ethylene terephthalate and polyoxyethylene terephthalate at a molar ratio of ethylene terephthalate units to polyoxyethylene terephthalate units of from about 25:75 to about 35:65, said polyoxyethylene terephthalate containing polyoxyethylene blocks having a molecular weight of from about 300 to about 700, the molecular weight of said soil release polymer being in the range of from about 25,000 to about 55,000 and the melting point of said polymer being below 100° C.

7. An article according to claim 3 wherein said polymeric soil release agent is a crystallizable polyester copolymer with repeat units of ethylene terephthalate units containing 10–50% by weight of ethylene terephthalate units together with 90–50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1.

8. An article according to claim 7 wherein the polyoxyethylene terephthalate units of said polymeric soil release agent are derived from a polyethylene glycol of average molecular weight of from about 1000 to about 4000.

9. An article according to claim 7 wherein said polymeric soil release agent has a softening phase transition temperature of at least about 30° C., and becomes a flowable liquid below 100° C.

10. An article according to claim 9 wherein said polymeric soil release agent becomes a flowable liquid below 90° C. and is present at a level of from about 25% to about 50% by weight of the fabric conditioning composition.

11. An article according to claim 3 wherein said polymeric soil release agent has the formula:

$$X\text{-}[(OCH_2CH_2)_n(OR^3)_m]\text{-}[(A\text{—}R^1\text{—}A\text{—}R^2)_u(A\text{—}R^3\text{—}A\text{—}R^2)_v]\text{-}$$

$$\text{—}A\text{—}R^4\text{—}A\text{-}[(R^5O)_m(CH_2CH_2O)_n]\text{-}X$$

wherein the A moieties are essentially $$\text{—}\overset{O}{\overset{\|}{C}}\text{—} \text{ or } \text{—}\overset{O}{\overset{\|}{C}}\text{O—}$$

moieties; the $R^1$ moieties are essentially 1,4-phenylene moieties; and $R^2$ moieties are essentially ethylene moieties, or substituted ethylene moieties having $C_1$–$C_4$ alkyl or alkoxy substituents; the $R^3$ moieties are substituted $C_2$–$C_{18}$ hydrocarylene moieties having at least one —$SO_3M$, —COOM, —O-[$(R^5O)_m(CH_2CH_2O)_n$]-X or —A-[$(R^2$—A—$R^4$—A)]$_w$[$R^5O)_m(CH_2CH_2O)_n$]-X substituent or at least one moiety —A-[($R^2$—A—$R^4$—A)]$_w$$R^2$]-A— crosslinked to another $R^3$ moiety; the $R^4$ moieties are $R^1$ or $R^3$ moieties, or a mixture thereof; each $R^5$ is $C_3$–$C_4$ alkylene, or the moiety —$R^2$—A—$R^6$—, wherein $R^6$ is a $C_1$–$C_{12}$ alkylene, alkenylene, arylene or alkarylene moiety; each M is H or a water-soluble cation; each X is H, $C_1$–$C_4$ alkyl or $$\text{—}\overset{O}{\overset{\|}{C}}R^7,$$

wherein $R^7$ is $C_1$–$C_4$ alkyl; m and n are numbers such that the moiety —$(CH_2CH_2O)$-comprises at least about 50% by weight of the moiety -[$R^5O)_m(CH_2CH_2O)_n$]-, provided that when $R^5$ is the moiety —$R^2$—A—$R^6$—, m is 1; each n is at least about 10; u and v are numbers such that the sum of u+v is from about 3 to about 25; w is 0 or at least 1; and when w is at least 1, u, v and w are numbers such that the sum of u+v+w is from about 3 to about 25.

12. An article according to claim 3 wherein said polymeric soil release agent has the following formula:

$$X\text{—}(OCH_2CH_2)_n\text{-}[(\text{—}\overset{O}{\overset{\|}{C}}\text{O—}R^1\text{—}\overset{O}{\overset{\|}{C}}\text{O—}R^2)]_u\text{-}\overset{O}{\overset{\|}{C}}\text{O—}R^1\text{—}\overset{O}{\overset{\|}{C}}\text{O—}(CH_2CH_2O)_n\text{—}X$$

wherein each $R^1$ is a 1,4-phenylene moiety; the $R^2$ consist essentially of ethylene moieties, 1,2-propylene moieties or a mixture thereof; each X is ethyl or preferably methyl; each n is from about 12 to about 43; u is from about 3 to about 10.

13. An article according to claim 3 wherein said polymeric soil release agent is a cellulosic polymer.

14. An article according to claim 13 wherein said polymeric soil release agent is selected from the group consisting of methyl cellulose, hydroxypropyl methylcellulose, or hydroxybutyl methylcellulose, said cellulosic polymer having a viscosity in 2% aqueous solution at 20° C. of 15 to 75,000 centipoise.

15. An article according to claim 2 wherein the said polymeric soil release agent is a solid at room temperature, has a softening phase transition temperature of at least about 30° C. and becomes a flowable liquid below 100° C.

16. An article according to claim 5 wherein said fabric softening agent comprises a mixture of from about 5% to about 25% of a quaternary ammonium salt, from about 10% to about 50% of a sorbitan polyester, and from about 5% to about 25% of a fatty amine, all percentages by weight of the fabric conditioning composition.

17. An article according to claim 16 wherein (a) said quaternary ammonium salt is selected from the group consisting of dialkyldimethylammonium salt wherein the alkyl groups can be the same or different and contain from about 14 to about 22 carbon atoms and wherein the counteranion is selected from the group consisting of chloride, methylsulfate and ethylsulfate ions, (b) said fatty alkyl sorbitan ester is selected from the group consisting of $C_{10}$–$C_{26}$ alkyl sorbitan monoesters, $C_{10}$–$C_{26}$ alkyl sorbitan diesters, and ethoxylates of said esters wherein one or more of the unesterified hydroxyl groups in said esters contain from 1 to about 6 oxyethylene units, and mixtures thereof, and (c) said fatty amine is selected from the group consisting of alkyldimethylamine and dialkylmethylamine, and mixtures thereof, wherein the alkyl groups can be the same or different and contain from about 14 to about 22 carbon atoms.

18. An article according to claim 17 wherein said fabric softening agent comprises a mixture of from about 7% to about 20% of said quaternary ammonium methylsulfate, from about 20% to about 40% of said sorbitan polyester, and from about 7% to about 20% of said fatty amine, all percentages by weight of the fabric conditioning composition.

19. An article according to claim 5 wherein said fabric softening agent comprises a mixture of from about 5% to about 25% of a quaternary ammonium salt, from about 10% to about 50% of a carboxylic acid salt of a tertiary alkylamine, and from about 10% to about 25% of said fatty alcohol, all percentages by weight of the fabric conditioning composition.

20. An article according to claim 19 wherein (a) said quaternary ammonium salt is selected from the group consisting of a dialkyldimethylammonium salt wherein the alkyl groups can be the same or different and contain from about 14 to about 22 carbon atoms and wherein the counteranion is selected from the group consisting of chloride, methylsulfate and ethylsulfate ions, (b) said carboxylic acid salt of a tertiary alkylamine is selected from the group consisting of fatty acid salts of alkyldimethylamines wherein the alkyl group contains from about 14 to about 22 carbon atoms, and (c) said fatty alcohol contains from about 14 to about 22 carbon atoms.

21. An article according to claim 20 wherein said fabric softening agent comprises a mixture of from about 7% to about 20% of said quaternary ammonium methylsulfate, from about 15% to about 35% of said fatty acid salt of a tertiary alkylamine, and from about 10% to about 20% of said fatty alcohol.

22. An article according to claim 2 wherein the substrate has an absorbent capacity of from about 4 to about 12 and the fabric conditioning composition is impregnated into the substrate and wherein the weight ratio of fabric conditioning composition to substrate on a dry weight basis ranges from about 5:1 to 1:1.

23. An article according to claim 22 wherein said substrate is a nonwoven cloth comprising cellulosic fibers, said fibers having a length of from 3/16 inch to 2 inches and a denier of from 1.5 to 5 and wherein said fibers are adhesively bonded together with a binder resin.

24. An article according to claim 23 wherein the flexible substrate has openings sufficient in size and number to reduce restriction by said article of the flow of air through an automatic laundry dryer.

25. An article according to claim 24 wherein the openings comprise a plurality of rectilinear slits extended along one dimension of the substrate.

26. An article according to claim 25 wherein said fabric softening agent comprises a mixture of cationic fabric softener and nonionic fabric softener and said soil release agent contains a crystallizable polyester with repeat units of ethylene terephthalate units containing 10–50% by weight of ethylene terephthalate units together with 90 to 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1.

27. An article according to claim 26 wherein said fabric softening agent comprises a mixture of:

(a) from about 7% to about 20% of a dialkyldimethylammonium methylsulfate wherein the alkyl groups can be the same of different and contain from about 14 to about 22 carbon atoms;

(b) from about 15% to about 35% of a fatty acid salt of a tertiary alkylamine wherein the alkyl group contains from about 14 to about 22 carbon atoms; and (c) from about 10% to about 20% of a fatty alcohol containing from about 14 to about 22 carbon atoms;

all percentages by weight of the fabric conditioning composition.

28. An article according to claim 27 wherein (a) said dialkyldimethylammonium methylsulfate is ditallowdimethylammonium methylsulfate;

(b) said fatty acid salt of a tertiary alkylamine is stearyldimethylammonium salt of tallow fatty acid;

(c) said fatty alcohol is a $C_{16}$–$C_{18}$ alcohol;

(d) said polymeric soil release agent has a softening phase transition temperature of at least about 30° C., and becomes a flowable liquid below 100° C.; and (e) said fabric conditioning composition further contains from about 2% to about 10% of a particulate clay and from about 0.5% to about 4% of a perfume.

29. An article of manufacture adapted for providing fabric soil release and softening benefits within an automatic clothes dryer, said article comprising:

(a) a fabric conditioning composition being solid at room temperature and flowable at dryer operating temperatures, said fabric conditioning composition comprising:

i. 1% to 70% of a polymeric soil release agent; and ii. 30% to 99% of a fabric softening agent selected from cationic and nonionic fabric softeners and mixtures thereof;

wherein said fabric conditioning composition is a high-shear mixture and said polymeric soil release agent is a fine dispersion;

(b) dispensing means which provides for release of said conditioning composition within an automatic laundry dryer at dryer operating temperatures.

30. An article according to claim 29 wherein said dispensing means comprises a flexible substrate in sheet configuration having the fabric conditioning composition releasably affixed thereto to provide a weight ratio of fabric conditioning composition to dry substrate ranging from about 10:1 to about 0.5:1 and wherein said affixed fabric conditioning composition has a dry, nonsticky tactile feel.

31. An article according to claim 30 wherein said polymeric soil release agent is present at a level of from about 10% to about 70% by weight of the fabric conditioning composition.

32. An article according to claim 30 wherein said fabric softening agent comprises a mixture of from about 5% to about 80% of a cationic fabric softener and from about 10% to about 85% of a nonionic fabric softener by weight of said fabric conditioning composition.

33. An article according to claim 32 wherein said cationic fabric softener is selected from the group consisting of:

(a) a quaternary ammonium salt; and (b) a carboxylic acid salt of a tertiary alkylamine;

and mixtures of (a) and (b); and wherein said nonionic fabric softener is selected from the group consisting of:

(c) a fatty alkyl sorbitan ester;

(d) a fatty alcohol; and (e) a fatty amine;

and binary and ternary mixtures of (c), (d) and (e).

34. An article according to claim 31 wherein the soil release agent is a polymer comprising repeating units of ethylene terephthalate and polyoxyethylene terephthalate at a molar ratio of ethylene terephthalate units to polyoxyethylene terephthalate units of from about 25:75 to about 35:65, said polyoxyethylene terephthalate containing polyoxyethylene blocks having a molecular weight of from about 300 to 700, the molecular weight of said soil release polymer being in the range of from about 25,000 to about 55,000 and the melting point of said polymer being below 100° C.

35. An article according to claim 31 wherein said polymeric soil release agent is a crystallizable polyester copolymer with repeat units of ethylene terephthalate units containing 10–50% by weight of ethylene terephthalate units together with 90–50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1.

36. An article according to claim 35 wherein the polyoxyethylene terephthalate units of said polymeric soil release agent are derived from a polyethylene glycol of average molecular weight of from about 1000 to about 4000.

37. An article according to claim 35 wherein said polymeric soil release agent has a softening phase transition temperature of at least about 30° C., and becomes a flowable liquid below 100° C.

38. An article according to claim 37 wherein said polymeric soil release agent becomes a flowable liquid below 90° C. and is present at a level of from about 25% to about 50% by weight of the fabric conditioning composition.

39. An article according to claim 31 wherein said polymeric soil release agent has the formula:

$$X\text{-}[(OCH_2CH_2)_n(OR^3)_m]_t[(A\text{—}R^1\text{—}A\text{—}R^2\text{-})_u(A\text{—}R^3\text{—}A\text{—}R^2)_v]\text{-}$$

$$\text{—}A\text{—}R^4\text{—}A\text{-}[(R^5O)_m(CH_2CH_2O)_n]\text{-}X$$

wherein the A moieties are essentially $$\text{—}\overset{O}{\overset{\|}{C}}\text{—} \quad \text{or} \quad \text{—}\overset{O}{\overset{\|}{C}}\text{O—}$$

moieties; the $R^1$ moieties are essentially 1,4-phenylene moieties; and $R^2$ moieties are essentially ethylene moieties, or substituted ethylene moieties having $C_1$–$C_4$ alkyl or alkoxy substituents; the $R^3$ moieties are substituted $C_2$–$C_{18}$ hydrocarylene moieties having at least one $\text{—}SO_3M$, —COOM, $\text{—O-}[(R^5O)_m(CH_2CH_2O)_n]\text{-}X$ or $\text{—A-}[(R^2\text{—A—}R^4\text{—A})]_w[(R^5O)_m(CH_2CH_2O)_n]\text{-}X$ substituent or at least one moiety $\text{—A-}[(R^2\text{—A—}R^4\text{—A})]_w R^2\text{—A—}$ crosslinked to another $R^3$ moiety; the $R^4$ moieties are $R^1$ or $R^3$ moieties, or a mixture thereof; each $R^5$ is $C_3$–$C_4$ alkylene, or the moiety $\text{—}R^2\text{—A—}R^6\text{—}$, wherein $R^6$ is a $C_1$–$C_{12}$ alkylene, alkenylene, arylene or alkarylene moiety; each M is H or a water-soluble cation; each X is H, $C_1$–$C_4$ alkyl or $$\text{—}\overset{O}{\overset{\|}{C}}R^7,$$

wherein $R^7$ is $C_1$–$C_4$ alkyl; m and n are numbers such that the moiety —($CH_2CH_2O$)-comprises at least about 50% by weight of the moiety $\text{-}[(R^5O)_m(CH_2CH_2O)_n]\text{-}$, provided that when $R^5$ is the moiety $\text{—}R^2\text{—A—}R^6\text{—}$, m is 1; each n is at least about 10; u and v are numbers such that the sum of u+v is from about 3 to about 25; w is 0 or at least 1; and when w is at least 1, u, v and w are numbers such that the sum of u+v+w is from about 3 to about 25.

40. An article according to claim 31 wherein said polymeric soil release agent has the following formula:

$$X\text{—}(OCH_2CH_2)_n\text{-}[(\text{—}\overset{O}{\overset{\|}{C}}\text{—}R^1\text{—}\overset{O}{\overset{\|}{C}}\text{O—}R^2)]_u\overset{O}{\overset{\|}{C}}\text{—}R^1\text{—}\overset{O}{\overset{\|}{C}}\text{O—}(CH_2CH_2O)_n\text{—}X$$

wherein each $R^1$ is a 1,4-phenylene moiety; the $R^2$ consist essentially of ethylene moieties, 1,2-propylene moieties or a mixture thereof; each X is ethyl or preferably methyl; each n is from about 12 to about 43; u is from about 3 to about 10.

41. An article according to claim 31 wherein said polymeric soil release agent is a cellulosic polymer.

42. An article according to claim 41 wherein said polymeric soil release agent is selected from the group consisting of methyl cellulose, hydroxypropyl methylcellulose, or hydroxybutyl methylcellulose, said cellulosic polymer having a viscosity in 2% aqueous solution at 20° C. of 15 to 75,000 centipoise.

43. An article according to claim 30 wherein the said polymeric soil release agent is a solid at room temperature, has a softening phase transition temperature of at least about 30° C. and becomes a flowable liquid below 100° C.

44. A method for imparting an improved combination of soil release, softening and antistatic effects to fabrics in an automatic laundry dryer comprising commingling pieces of damp fabrics by tumbling said fabrics under heat in an automatic clothes dryer with an effective amount of a fabric conditioning composition, said composition being solid at room temperature and flowable at dryer operating temperatures, said composition comprising from about 1% to 70% of a polymeric soil release agent, and 30% to 99% of a fabric softening agent; and wherein the fabric conditioning composition is applied to the fabrics from a flexible substrate.

45. A method according to claim 44 wherein the fabric conditioning composition comprises:

(a) from about 7% to about 20% of ditallowdimethylammonium methylsulfate;

(b) from about 15% to about 35% of stearyldimethylammonium salt of tallow fatty acid;

(c) from about 10% to about 20% of $C_{16}$–$C_{18}$ fatty alcohol;

(d) from about 10% to about 60% of a crystallizable polyester copolymer with repeat units of ethylene terephthalate units containing 10–50% by weight of ethylene terephthalate units together with 90–50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1, said copolymer having a softening phase transition temperature of at least about 30° C., and becomes a flowable liquid below 100° C.;

(e) from about 2% to about 10% of a particular clay; and (f) from about 0.5% to about 4% of a perfume.

* * * * *

UNITED STATES PATENT AND TRADEMARK OFFICE

CERTIFICATE OF CORRECTION

PATENT NO. : 4,808,086

DATED : February 28, 1989

INVENTOR(S) : Mark D. Evans, Gregory B. Huntington, Robert L. Stewart, Peter H. Wolf and Roger E. Zimmerer It is certified that error appears in the above-identified patent and that said Letters Patent is hereby corrected as shown below:

In the ABSTRACT, line 5, after "automatic" add -- clothes dryer and are provided with a soft, antistatic finish and --.

Col. 1, line 64, after "a" and before "fabric" insert -- solid --.

Col. 1, line 65 after "a" and before "fabric" delete -- solid --.

Col. 4, line 63, "185" should read -- 195 --.

Col. 8, line 32, "a" should read -- an --.

Col. 14, line 10, in Table III, EX. 6, "-0.2" should read -- -0.1 --.

Signed and Sealed this

Seventeenth Day of April, 1990

*Attest:*

HARRY F. MANBECK, JR.

*Attesting Officer*

*Commissioner of Patents and Trademarks*